US009818395B2

(12) United States Patent
Kumo et al.

(10) Patent No.: US 9,818,395 B2
(45) Date of Patent: Nov. 14, 2017

(54) ACOUSTIC DIAPHRAGM

(71) Applicant: Onkyo Corporation, Osaka (JP)

(72) Inventors: Hiroyasu Kumo, Osaka (JP); Takaya Fujii, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 15/341,044

(22) Filed: Nov. 2, 2016

(65) Prior Publication Data

US 2017/0206885 A1 Jul. 20, 2017

(30) Foreign Application Priority Data

Jan. 15, 2016 (JP) ..... 2016-006023

(51) Int. Cl.

| | |
|---|---|
| ***H04R 7/02*** | (2006.01) |
| ***G10K 13/00*** | (2006.01) |
| ***D21H 11/18*** | (2006.01) |
| *H04R 7/00* | (2006.01) |

(52) U.S. Cl.
CPC ..... *G10K 13/00* (2013.01); *D21H 11/18* (2013.01)

(58) Field of Classification Search
CPC ..... H04R 2307/021; H04R 2307/029
USPC ..... 181/167, 169; 381/426, 428
See application file for complete search history.

(56) References Cited

U.S. PATENT DOCUMENTS

| | | | | |
|---|---|---|---|---|
| 7,945,069 | B2 * | 5/2011 | Mango, III | H04R 7/125 181/167 |
| 2014/0355780 | A1 * | 12/2014 | Fukushima | H04R 7/12 381/74 |
| 2016/0134971 | A1 * | 5/2016 | Kajihara | H04R 31/003 381/400 |
| 2016/0134972 | A1 * | 5/2016 | Shibuya | H04R 7/10 381/405 |
| 2016/0212540 | A1 * | 7/2016 | Shibuya | H04R 7/06 |

FOREIGN PATENT DOCUMENTS

| | | |
|---|---|---|
| JP | 2011-130401 A | 6/2011 |
| JP | 2013-042405 A | 2/2013 |

* cited by examiner

*Primary Examiner* — Edgardo San Martin
(74) *Attorney, Agent, or Firm* — Renner Otto Boisselle & Sklar, LLP

(57) ABSTRACT

An acoustic diaphragm which has excellent Young's modulus and internal loss (tan δ) values is provided. The acoustic diaphragm according to the present invention is made from papermaking material substantially solely including cellulose nanofibers. In one embodiment, the cellulose nanofibers are unoxidized cellulose nanofibers.

2 Claims, 1 Drawing Sheet

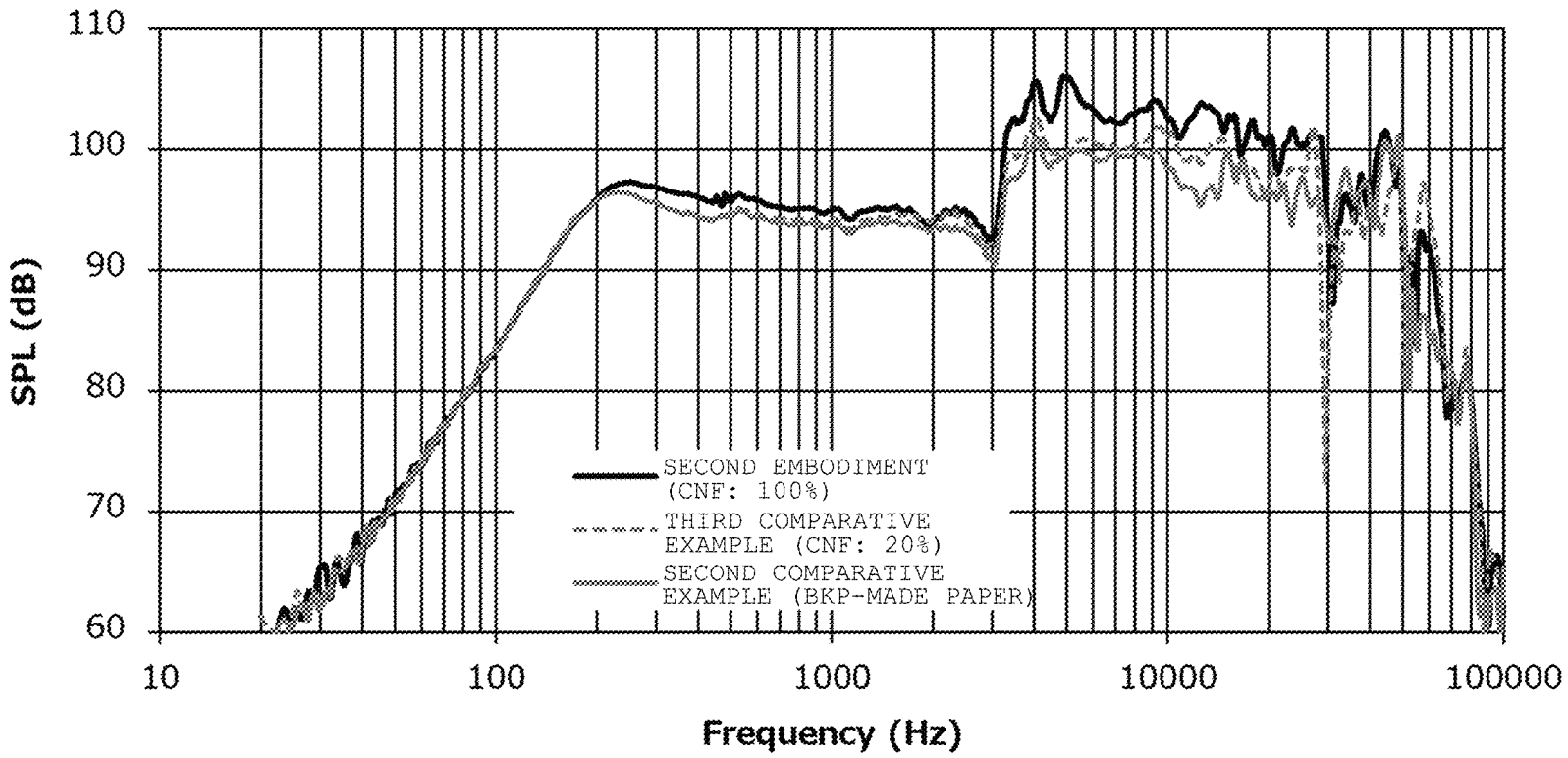
SPL (dB)
110
100
90
80
70
60
10
100
1000
10000
100000
Frequency (Hz)
SECOND EMBODIMENT (CNF: 100%)
THIRD COMPARATIVE EXAMPLE (CNF: 20%)
SECOND COMPARATIVE EXAMPLE (BKP-MADE PAPER)

ACOUSTIC DIAPHRAGM

BACKGROUND OF THE INVENTION

1. Field of the Invention

The present invention relates to an acoustic diaphragm and, more particularly, to an acoustic diaphragm for use in speakers, headphones and the like.

2. Description of the Related Art

Generally, an acoustic diaphragm used for a speaker, a headphone and the like is required to have characteristics such as high various strengths, high airtightness, high Young's modulus (modulus of elasticity; rigidity), and large internal loss (tan δ). To address such needs, studies have continuously been made regarding acoustic diaphragm materials and structures. For example, JP-A-2013-42405 and JP-A-2011-130401 disclose speaker diaphragm materials and structures.

The present invention has been made to solve the above problems, and an object of the present invention is to provide an acoustic diaphragm which has excellent Young's modulus and internal loss (tan δ) values.

SUMMARY OF THE INVENTION

The acoustic diaphragm according to the present invention is made from papermaking material which substantially solely includes cellulose nanofibers.

In one embodiment, the cellulose nanofibers are unoxidized cellulose nanofibers.

The acoustic diaphragm according to the present invention, being made from cellulose nanofibers, has excellent Young's modulus and internal loss (tan δ) values.

BRIEF DESCRIPTION OF THE DRAWINGS

FIG. 1 is a diagram illustrating the frequency characteristics of an acoustic diaphragms obtained in the second embodiment, the second comparative example, and the third comparative example.

DETAILED DESCRIPTION OF THE PREFERRED EMBODIMENTS

An acoustic diaphragm according to the embodiments of the present invention is obtained by making paper from cellulose nanofibers. The acoustic diaphragm is made from a papermaking material which substantially solely includes cellulose nanofibers. Use of the papermaking material of cellulose nanofibers makes it possible to obtain an acoustic diaphragm with a dense structure in which the fibers are strongly bonded by hydrogen bonds. Accordingly, an acoustic diaphragm having excellent Young's modulus values can be obtained. In addition, the acoustic diaphragm according to the present invention exhibits excellent values of density, airtightness, strength and the like, has wide high-frequency reproduction bands, and can provide excellent sound quality.

The cellulose nanofibers refer to cellulose fibers with a nano-sized fiber diameter. The cellulose nanofibers have a fiber diameter (number average diameter) of 3 nm to 100 nm, for example. The cellulose nanofibers have a length (number average length) of 0.1 μm to 100 μm, for example. The cellulose nanofibers have an aspect ratio (length/diameter) of 50 to 1000, for example. The pulp normally has a fiber diameter of not less than 1 μm. In the present specification, cellulose nanofibers and pulp are distinguished by their fiber diameters.

In the acoustic diaphragm according to the embodiments of the present invention, compared with conventional acoustic diaphragms including pulp fibers with the large fiber diameter with a small amount of cellulose nanofibers with a diameter of one thousandth or less added and mixed therewith, the papermaking material solely including cellulose nanofibers is much denser and has a strong hydrogen bond, whereby airtightness is significantly increased. Accordingly, the acoustic diaphragm according to the embodiments has high capacity to push air as a sound wave medium, and can provide excellent sound quality.

Examples of the method for manufacturing cellulose nanofibers include an aqueous counter collision process (ACC process) whereby suspensions of pulp dispersed in water are collided for fibrillation and size reduction, and a method whereby cellulose raw material is fibrillated by a mechanical process. The mechanical process for reducing the size of the cellulose raw material may include, for example, the use of a low-pressure homogenizer, a high-pressure homogenizer, a grinder, a cutter mill, a jet mill, a single-screw extruder, a twin-screw extruder, or an ultrasonic stirrer. The cellulose nanofibers can be manufactured by fibrillating cellulose raw material by chemical treatment, such as oxygen treatment or acid treatment. However, in the present invention, it is preferable to use unoxidized cellulose nanofibers obtained by, e.g., the aqueous counter collision process (ACC process) or a mechanical process. Use of unoxidized cellulose nanofibers makes it possible to form the papermaking material solely including cellulose nanofibers, whereby an acoustic diaphragm in which the Young's modulus, internal loss (tan δ), airtightness, and various strengths are well balanced can be obtained.

The cellulose raw material is not particularly limited, and any appropriate cellulose raw material may be used. Examples of the cellulose raw material include wood-derived kraft pulps, such as leaf bleached kraft pulp (LBKP), leaf unbleached kraft pulp (LUKP), hardwood kraft pulp (LKP), needle bleached kraft pulp (NBKP), and needle unbleached kraft pulp (NUKP); waste paper pulp such as sulfite pulp and deinked pulp (DIP); ground pulp (GP); and mechanical pulp such as pressure ground wood pulp (PGW), refiner mechanical pulp (RMP), thermomechanical pulp (TMP), chemical thermomechanical pulp (CTMP), chemical mechanical pulp (CMP), and chemical ground pulp (CGP). These pulps may be pulverized to obtain powdered cellulose or pulp, which may then be refined by a chemical process such as acid hydrolysis, obtaining microcrystalline cellulose for use. In addition, non-wood pulp derived from kenaf, hemp, rice, bagasse, reed, bamboo, cotton and the like may be used. In one embodiment, softwood-derived cellulose is used as the raw material for cellulose nanofibers. Use of the softwood-derived cellulose makes it possible to obtain an acoustic diaphragm having an increased Young's modulus.

In the present specification, by "substantially solely including cellulose nanofibers" is meant that the content rate of the cellulose nanofibers is not less than 90 parts by weight with respect to 100 parts by weight of the acoustic diaphragm. The content rate of cellulose nanofibers is preferably not less than 95 parts by weight, more preferably not less than 98 parts by weight, and even more preferably 100 parts by weight with respect to 100 parts by weight of the acoustic diaphragm.

The acoustic diaphragm may include a minute amount of components other than cellulose nanofibers. For example, with respect to 100 parts by weight of the acoustic diaphragm, wood pulp may be added at the content rate of less than 10 parts by weight (preferably less than 5 parts by weight, more preferably less than 2 parts by weight). The acoustic diaphragm including cellulose nanofibers and a minute amount of wood pulp can be obtained by mixing these materials. The wood pulp is not particularly limited, and wood pulp normally used in acoustic diaphragms may be adopted. Examples are softwood-based pulp and hardwood-based pulp.

The acoustic diaphragm may additionally contain other fibers as needed. The other fibers may be selected as appropriate in accordance with the purpose. For example, if the purpose is to increase mechanical strength, high-strength fiber may be mixed. In addition, a fiber for a particular purpose (such as deodorant fiber or minus ion-releasing fiber) may be mixed.

The acoustic diaphragm has a density of preferably not less than 0.45 g/cc and more preferably not less than 0.5 g/cc. When in such ranges, an acoustic diaphragm which is particularly excellent in Young's modulus can be obtained.

The folding endurance of the acoustic diaphragm is preferably not less than 1000 times, more preferably not less than 2000 times, and even more preferably not less than 2500 times. The folding endurance is measured in accordance with JIS P 8115.

The stiffness of the acoustic diaphragm is preferably 1000 mgf to 5000 mgf, and more preferably 1500 mgf to 3000 mgf.

When in such ranges, an acoustic diaphragm that has particularly excellent Young's modulus values can be obtained. The stiffness is measured in accordance with JIS P 8125.

The tearing strength of the acoustic diaphragm is preferably not less than 200 gf, and more preferably not less than 300 gf. The tearing strength is measured in accordance with JIS P 8116.

The acoustic diaphragm has an airtightness of preferably not less than 15 s/100 cc, more preferably not less than 100 s/100 cc, and even more preferably not less than 1000 s/100 cc. A method for measuring airtightness will be described later.

The acoustic diaphragm according to the present invention can be obtained by making paper from the cellulose nanofibers by any appropriate method, and then forming a flat sheet obtained by the papermaking into a predetermined shape. Preferably, during papermaking, nonwoven cloth is used as a wire cloth. Use of nonwoven cloth as wire cloth during the process of papermaking using the cellulose nanofibers with small fiber diameters enables the papermaking process to be performed in a satisfactory manner.

Examples of the material of the nonwoven cloth include polyester-based fiber, polyamide-based fiber, polyaramide-based fiber, polyolefin-based fiber, vinylon-based fiber, cellulose-based fiber, regenerated cellulose-based fiber, and fibers including a plurality of copolymers thereof.

The basis weight of the nonwoven cloth is preferably 50 $g/m^2$ to 200 $g/m^2$, and more preferably 100 $g/m^2$ to 150 $g/m^2$. When in such ranges, the papermaking process can be performed in a satisfactory manner.

The thickness of the nonwoven cloth is preferably 0.2 mm to 1 mm, and more preferably 0.3 mm to 0.7 mm. When in such ranges, the papermaking process can be performed in a satisfactory manner.

The flat sheet obtained by papermaking may be formed by any appropriate method. A specific example of the forming method is hot-press forming. The acoustic diaphragm may be given a predetermined shape suitable for a diaphragm, such as a substantially cone shape, by a papermaking process, and then subjected to hot-press forming. Alternatively, the acoustic diaphragm may be given a predetermined shape suitable for a diaphragm, such as a substantially cone shape, formed, and then dried in an oven.

The acoustic diaphragm according to the present invention may have any appropriate shape in accordance with the purpose. The acoustic diaphragm according to the present invention may have a cone shape, a dome shape, or other shapes, for example.

The acoustic diaphragm according to the present invention may be used in speakers or headphones for any use. For example, a speaker using the diaphragm of the present invention may be for mounting on a vehicle, for a portable electronic device (such as a portable telephone or portable music player), or for fixed installation. The speaker using the diaphragm of the present invention may have a large diameter, an intermediate diameter, or a small diameter. Preferably, the diaphragm of the present invention may be used for a small-diameter speaker.

Embodiments

In the following, the present invention will be described in more concrete terms with reference to embodiments. However, the present invention is not limited to the embodiments. In the embodiments, evaluation methods are as follows. Unless otherwise specifically indicated, the parts and percentages in the embodiments are with reference to weight.

<Evaluation>

1. Measurement of Young's modulus and internal loss (tan δ)

The Young's modulus and internal loss (tan δ) of the obtained flat plate were measured by the vibrating reed method (cantilever, resonance method). Specifically, from each of flat plates obtained in the embodiments and comparative examples, five test pieces of a size of 40 mm×15 mm were cut out, and the Young's modulus and internal loss (tan δ) of each test piece were measured at 23° C. In the table, average values of the five test pieces are shown.

2. Density

From each of the flat plates obtained in the embodiments and comparative examples, five test pieces of a size of 40 mm×15 mm were cut out. The thickness and weight of each test piece were measured at four points (i.e., 4 points×5 test pieces for a total of 20 points) using a dial thickness gauge, and an average density value was determined from the measured values.

3. Airtightness

From the flat sheets obtained in the embodiments and the comparative examples, five test pieces each with a size of 50 mm×50 mm were cut out and measured in accordance with JIS P 8117. Resultant average values are shown in the table.

First Embodiment

Into a papermaking tank in which a nonwoven cloth (polyester microfibers (3 μm)+polyurethane resin 5%; basis weight 140±10 $g/m^2$; and thickness 0.55±0.06 mm) was used as a wire cloth, a 0.1 wt % suspension of softwood-derived cellulose nanofibers (manufactured by Chuetsu Pulp & Paper Co., Ltd., with a fiber diameter of approximately 20 nm) was injected, made into paper, and thereafter hot-pressed using a molding die, obtaining a flat sheet made solely of micro/nanofibers (basis weight: 43.7 $g/m^2$). The obtained flat sheet was subjected to the evaluations 1 to 3. The results are shown in Table 1.

Second Embodiment

Paper was made using the same material and conditions as in the first embodiment and then hot-pressed using a molding die, obtaining a headphone driver diaphragm made solely of micro/nanofibers. With respect to the diaphragm, the frequency characteristics were measured, and sound quality was evaluated. The results are illustrated in FIG. 1.

First Comparative Example

BKP (degree of beating 500 cc) was made and press-dried, obtaining a flat sheet made solely of BKP (basis weight: 48.5 $g/m^2$). The obtained flat sheet was subjected to the evaluations 1 to 3. The results are shown in Table 1.

Second Comparative Example

Paper was made using the same material and condition as in the first comparative example, and then hot-pressed using a molding die, obtaining a headphone driver diaphragm made solely of BKP. With respect to the diaphragm, the frequency characteristics were measured, and sound quality was evaluated. The results are illustrated in FIG. 1.

Third Comparative Example

To 100 parts of BKP (degree of beating 500 cc), 20 parts of softwood-derived cellulose nanofibers (manufactured by Chuetsu Pulp & Paper Co., Ltd., with a fiber diameter of approximately 20 nm) was blended and mixed, and thereafter hot-pressed using a molding die, obtaining a headphone driver diaphragm. With respect to the diaphragm, the frequency characteristics were measured, and sound quality was evaluated. The results are illustrated in FIG. 1.

TABLE 1

| | Basis Weight ($g/m^2$) | Thickness (mm) | Density (g/cc) | E ($dyn/cm^2$) | tan δ | Airtightness (s/100 cc) |
|---|---|---|---|---|---|---|
| First Embodiment | 43.7 | 0.078 | 0.562 | $1.09 \times 10^{10}$ | 030528 | 3472.5 |
| First Comparative Example | 48.5 | 0.11 | 0.44 | $7.84 \times 10^{9}$ | 0.0496 | 1 |

As will be seen from Table 1, the diaphragm made solely of cellulose nanofibers has a strong bond between fibers, and has superior physical properties of density, Young's modulus, airtightness and the like. In addition, as will be seen from FIG. 1, the diaphragm provides increased sound pressure in high frequencies, and exhibits good characteristics and sound quality. In terms of sound quality, an increase in sound pressure in high-frequency reproduction bands is achieved; the amount of information is increased; mid- to high-frequency energy emission is facilitated; S/N is improved; and mid- to high-frequency sharpness is improved. In addition, the overall strength and airtightness are also increased, whereby an increase in low frequencies was achieved.

INDUSTRIAL APPLICABILITY

The acoustic diaphragm according to the present invention can be suitably used in speakers or headphones for any purposes.

What is claimed is:

1. An acoustic diaphragm comprising a papermaking material substantially solely including cellulose nanofibers, wherein a content rate of the cellulose nanofibers is not less than 90 parts by weight with respect to 100 parts by weight of the acoustic diaphragm.

2. The acoustic diaphragm according to claim 1, wherein the cellulose nanofibers are unoxidized cellulose nanofibers.

* * * * *